United States Patent [19]

Dooley

[11] Patent Number: 5,037,389

[45] Date of Patent: Aug. 6, 1991

[54] PORTABLE LIQUID MEDICINE DISPENSER

[76] Inventor: Karen M. Dooley, 29 Mobile Ave., Staten Island, N.Y. 10306

[21] Appl. No.: 453,408

[22] Filed: Dec. 19, 1989

[51] Int. Cl.[5] ..... A61J 7/00

[52] U.S. Cl. ..... 604/77; 604/78; 604/260; 222/526; 222/566

[58] Field of Search ..... 604/57, 58, 77, 78, 604/187, 255, 260; 141/22, 23, 243; 222/526, 566; 221/30; 215/260, 311; 73/294; 220/266

[56] References Cited

U.S. PATENT DOCUMENTS

| | | | |
|---|---|---|---|
| 2,550,210 | 4/1951 | Vance, Jr. | 604/77 |
| 2,673,563 | 3/1954 | Kwast | 604/77 |
| 3,297,208 | 1/1967 | Swett | 222/526 |
| 3,302,644 | 2/1967 | Kennedy et al. | 215/311 |

FOREIGN PATENT DOCUMENTS

| | | | |
|---|---|---|---|
| 854283 | 4/1940 | France | 222/526 |

*Primary Examiner*—Stephen C. Pellegrino
*Assistant Examiner*—Glenn K. Dawson
*Attorney, Agent, or Firm*—Collard, Roe & Galgano

[57] ABSTRACT

A medicine dispensing device for dispensing measured amounts of liquids to infants and the like, consisting of a container that has a plurality of calibration marks formed along its edge and has a cap disposed over its open end. Along its sides is a dosing dispenser which can be slidably moved toward the open end of the container so that its trough will communicate with the open mouth of the container and liquids such as medicines that are put into the container can be easily dispensed to an infant. The trough is held by a split-ring sleeve which fits around the container and includes a foot sticking out from the split ring so that the dispenser can be set flat on a table without rolling off.

5 Claims, 1 Drawing Sheet

PORTABLE LIQUID MEDICINE DISPENSER

This invention relates to an improved liquid medicine dispenser for administering a dose of medicine, food, vitamins or the like to infants, small children and adults.

DESCRIPTION OF THE PRIOR ART

More specifically this invention relates to an improved and portable liquid medicine dispenser which is safe when used around small infants for administering small and measured doses of medicine.

DISCUSSION OF THE PRIOR ART

In the prior art there have been a number of medicine dispensers or dosing devices that have been used to apply medicine to the mouth of a person in premeasured doses. In the patent to Kwast, U.S. Pat. No. 2,673,563, a medicine dispenser has been formed in the shape of a duck bill, having an oval opening at its end, wherein the medicine is dispensed by gravity. The Kwast unit is bulky and does not include a stopper. In the patent to Davenport, U.S. Pat. No. 1,825,339, a dosing device is shown having a circular, flattened tip which makes it easier to dispense medicine to older children. No cap is provided to close off the end. There are also other medicine dispensers in U.S. Pat. Nos. 3,310,193, 4,430,075, 4,245,752 and 2,314,052 which provide other ways of dispensing medicine.

BRIEF DESCRIPTION OF THE INVENTION

Accordingly, the present invention provides an improved portable liquid medicine dispenser consisting of a tubular container which is provided with calibration marks for determining the amount of medicine to be dispensed. The dispenser includes a spout which slides along the length of the dispenser and can be positioned in place as soon as the cap of the dispenser has been removed. The cap is also connected to a cap retaining device which slips over a lip at the end of the containing tube so as to prevent the cap from becoming accidentally dislodged. The medicine dispenser of the present invention is portable, easy to use, and acceptable to infants of all ages.

It is therefore an object, according to the present invention to provide a medicine dispenser which is simple in design, easy to manufacture and reliable in operation.

Other objects and features of the present invention will become apparent from the following detailed description considered in connection with the accompanying drawings which disclose the embodiments thereof. It is to be understood however that the drawing is designed for the purpose of illustration only, and not as a definition of the limits of the invention.

In the drawing, wherein similar reference characters denote similar elements throughout the several views:

DETAILED DESCRIPTION OF THE INVENTION

Figure 1:
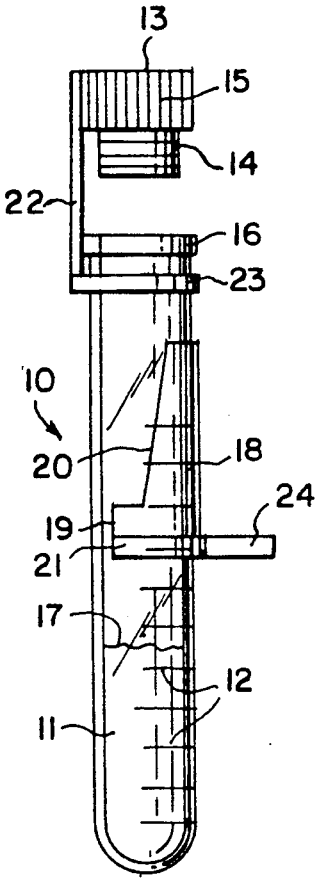
FIG. 1 is a plan view, partly in cross section, of the medicine dispenser of the invention.

Referring to FIGS. 1–6 there is shown the medicine dispenser according to the invention generally designated as 10, consisting of a closed, elongated container or tube 11, having a series of calibrations 12 etched or printed along its sides. Slidably secured to the side of the tube is a dosing dispenser 18, having sloping side walls 20, which define a trough for dispensing liquid. Dosing dispenser or tip 18 can be slid into position up to rim 16 at the end of tube 11 so that the entire medicine dispenser can be tipped to dispense medicine contained within the tube through the trough of the dosing device. When not in use, there is provided a cap 13 having a knurled side surface 15, and ribs 14 formed in the plug to form a tight seal when the cap is secured into the mouth of tube 11. In order to prevent the cap from becoming lost or accidentally swallowed by an infant or child, a cap retainer is provided consisting of a connecting arm 22 secured to the side of cap 13 and having a retaining ring 23 integrally formed thereon. Retaining ring 23 is designed to have an inner diameter approximately equal to the outer diameter of tube 11, so that it can be slipped on the closed bottom of the tube and prevent the cap from becoming dislodged. The cap retainer which includes arm 22 and ring 23 is preferably constructed of flexible plastic so the cap can be moved away from the opening of the container formed aroung lip 16 in order to allow the contents contained therein to be dispensed through dosing dispenser 18.

Figure 2:
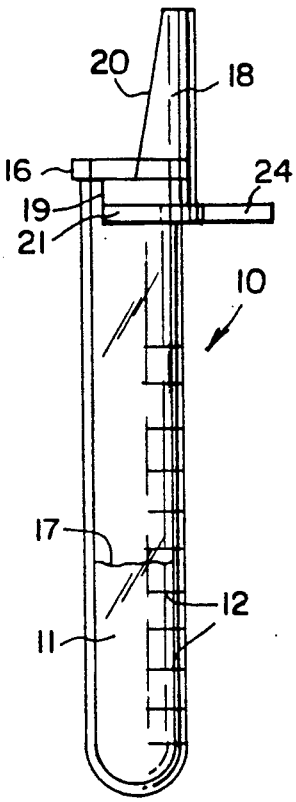
FIG. 2 shows the medicine dispenser of FIG. 1 with the cap removed and the dosing tip moved into place at the end of the dispenser.
Figure 3:
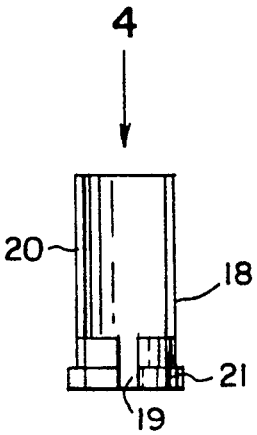
FIG. 3 is a detailed view of the dosing tip.
Figure 4:
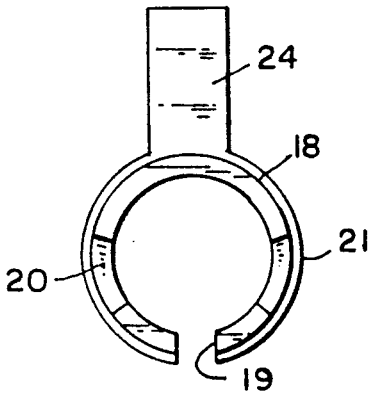
FIG. 4 is a cross-sectional view taken through section 4 of FIG. 3.
Figure 5:
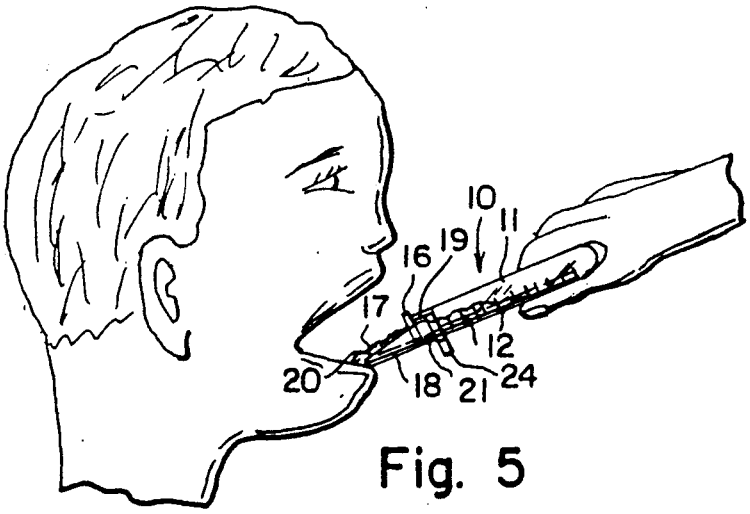
FIG. 5 is a perspective view showing the use of the medicine dispenser of the invention; and, FIG. 6 is a detailed view showing the retainer for the cap of the device.
Figure 6:
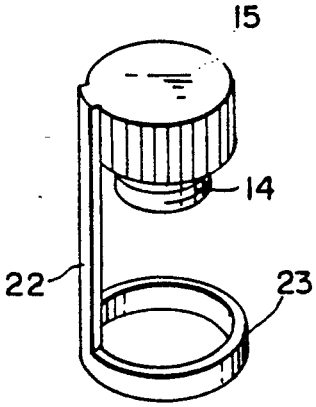

Dosing dispenser 18 is constructed as a sleeve mounted on a split ring 19 and 21 slightly smaller in diameter than the outer diameter of tube or container 11. Split ring 19 is designed to grip the walls of the container. It therefore can slide frictionally along the surface of the container to be either put into full operating position as shown in FIG. 2, or retracted as shown in FIG. 1. Its lower edge, or rim 21, includes a flat extension member or foot 24 to allow the entire dispenser to be set down on a flat surface without rolling off.

Ring 19 and rim 21 allow the inside trough of dispenser 18 to be axially displaced outwardly from the outer surface of the tube so that when the dispenser is slid upwardly, the trough will clear rim 16 at the end of the tube. The split ring 19 however engages rim 16 to prevent the dispenser from being dislodged off the end of the tube. In a similar manner, the trough is designed to also clear retaining ring 23 connected to the cap.

The structural elements of the medicine dispenser of the invention are preferably constructed of plastic materials. Dispensing tube or container 10 is preferably constructed of clear plastic and has calibration marks either etched or silk screened onto the sidewalls of the container. The calibration marks can be in metric or English units. Likewise, dosing tip 18 is preferably constructed of clear flexible plastic as well. The cap may be constructed of any rubber or flexible plastic sufficient to form a seal over the contents contained in tube 11.

In using the device of the invention, a measured portion of medicine, cough syrup or other liquid or powdered edible product is disposed into tubular container 10 and the cap is inserted to seal off contents. The entire medicine dispenser can be carried in a purse or a shirt pocket until it is ready for use. If the person needs medicine while away from home, the user merely removes the cap and slides the dosing device 18 into position as shown in FIG. 2 and places the lips of the person on the end of the dosing dispenser and tilts the container upwardly until the medicine or liquid material contained therein flows into the person's mouth. The dosing dispenser can then be retracted and the cap can be replaced and the unit can be reused after cleaning.

While only a single embodiment of the present invention has been shown and described, it is obvious that many changes and modifications may be made thereunto without departing from the spirit and scope of the invention.

What is claimed is:

1. A medicine dispensing device for dispensing measured amounts of liquids to persons, comprising;

a container having an open end, side walls and a plurality of calibration marks formed along said side walls;

a cap disposed over said open end of the container; and a dosing dispenser slidably secured along said side walls of the container, and having a trough in communication with said open end of the container for dispensing liquids from the container to the person, and having a split-ring sleeve for fitting around said container and supporting said trough.

2. The medicine dispensing device as recited in claim 1 additionally comprising a foot coupled to said dosing dispenser and extending perpendicular to said side walls for allowing the dosing dispenser to support the device on a flat surface.

3. The medicine dispensing device as recited in claim 2, wherein said cap additionally comprises a retaining ring for securing said cap to said container when said cap is removed from said container.

4. The medicine dispensing device as recited in claim 1 wherein said container comprises an elongated cylindrical tube having an enlarged rim formed at said open end for preventing the dosing dispenser from becoming dislodged off the end of said container.

5. The medicine dispensing device as recited in claim 4 wherein said trough is axially displaced from said split-ring sleeve by a distance sufficient to clear said tube rim.

* * * * *